US010814628B2

(12) United States Patent
Yamada et al.

(10) Patent No.: US 10,814,628 B2
(45) Date of Patent: Oct. 27, 2020

(54) LIQUID EJECTING HEAD, LIQUID EJECTING APPARATUS, AND WIRING SUBSTRATE

(71) Applicant: Seiko Epson Corporation, Tokyo (JP)

(72) Inventors: Daisuke Yamada, Hachioji (JP); Eiju Hirai, Azumino (JP); Motoki Takabe, Shiojiri (JP); Yoichiro Kondo, Chino (JP)

(73) Assignee: Seiko Epson Corporation (JP)

( * ) Notice: Subject to any disclaimer, the term of this patent is extended or adjusted under 35 U.S.C. 154(b) by 130 days.

(21) Appl. No.: 16/222,224

(22) Filed: Dec. 17, 2018

(65) Prior Publication Data

US 2019/0184703 A1 Jun. 20, 2019

(30) Foreign Application Priority Data

Dec. 20, 2017 (JP) ..... 2017-244255

(51) Int. Cl.
*B41J 2/00* (2006.01)
*B41J 2/14* (2006.01)

(52) U.S. Cl.
CPC ..... *B41J 2/1433* (2013.01); *B41J 2/14233* (2013.01); *B41J 2/14072* (2013.01); *B41J 2002/14419* (2013.01); *B41J 2002/14491* (2013.01)

(58) Field of Classification Search
CPC ..... B41J 2/1433; B41J 2/14233; B41J 2002/14419; B41J 2002/14491
See application file for complete search history.

(56) References Cited

U.S. PATENT DOCUMENTS 10,259,215 B2 * 4/2019 Tanaka ..... B41J 2/14233
2018/0015717 A1 1/2018 Tanaka

FOREIGN PATENT DOCUMENTS

JP 2016-172345 A 9/2016
JP 2017-124540 A 7/2017

OTHER PUBLICATIONS

Machine translation of JP 2017-124540, published on Jul. 2017 (Year: 2017).*
Machine translation of JP 2016-172345, published on Sep. 2016 (Year: 2016).*

* cited by examiner

*Primary Examiner* — Huan H Tran
(74) *Attorney, Agent, or Firm* — Harness, Dickey & Pierce, P.L.C.

(57) ABSTRACT

A liquid ejecting head includes a driving circuit configured to output a driving pulse; and a wiring substrate including a base body portion disposed between a flow path formation portion and the driving circuit, and a signal wiring formed on the base body portion and configured to transmit a driving signal for use in generation of the driving pulse by the driving circuit to the driving circuit from an input terminal. The signal wiring includes a first portion overlapping, in a plan view, at least one coupling terminal included in the driving circuit and coupled to the signal wiring, and a second portion located on the side of the input terminal when seen from the first portion, and the total number of wirings constituting the second portion is larger than the total number of wirings constituting the first portion.

15 Claims, 8 Drawing Sheets

LIQUID EJECTING HEAD, LIQUID EJECTING APPARATUS, AND WIRING SUBSTRATE

The entire disclosure of Japanese Patent Application No. 2017-244255, filed Dec. 20, 2017 is expressly incorporated by reference herein.

BACKGROUND

1. Technical Field

The present invention relates to techniques for ejecting liquid, such as ink or the like.

2. Related Art

Heretofore, liquid ejecting heads each configured to eject liquid, such as ink or the like, through a plurality of nozzles have been proposed. For example, in JP-A-2017-124540, there is disclosed a liquid ejecting head including a flow path formation substrate in which pressure generation chambers are formed; piezoelectric elements each configured to cause pressure inside a corresponding one of the pressure generation chambers to vary; and a driving circuit configured to supply driving signals to the respective piezoelectric elements. Further, a driving circuit substrate is disposed between the flow path formation substrate and the driving circuit. Moreover, wirings for transmitting, to the driving circuit, signals and power sources supplied from external circuits, and wirings for transmitting the driving signals, which are output from the driving circuit, to the respective piezoelectric elements are formed on the driving circuit substrate.

Under the techniques disclosed in JP-A-2017-124540, however, it is actually difficult to sufficiently lower the resistances of the wirings formed on the driving circuit substrate, and there is a room for further improvement from a viewpoint of the minimization of heat generation and waveform blunting of the driving signals due to the resistances of the wirings.

SUMMARY

An advantage of some aspects of the invention is that techniques that enable the realization of further lowering the resistances of wirings formed on a wiring substrate constituting a liquid ejecting head are provided.

In configuration 1, namely, a preferable configuration of a liquid ejecting head according to an aspect of the invention, the liquid ejecting head includes a flow path formation portion in which a plurality of pressure chambers each communicating with a corresponding one of a plurality of nozzles are formed; a plurality of driving elements each configured to cause liquid inside a corresponding one of the pressure chambers to be ejected through a corresponding one of the nozzles; a driving circuit configured to output a driving pulse for driving each of the driving elements to the each of the driving elements; and a wiring substrate including a base body portion disposed between the flow path formation portion and the driving circuit, and a signal wiring formed on the base body portion and configured to transmit a driving signal for use in generation of the driving pulse by the driving circuit to the driving circuit from an input terminal. Further, the signal wiring includes a first portion overlapping, in a plan view, at least one coupling terminal included in the driving circuit and coupled to the signal wiring, and a second portion located on the side of the input terminal when seen from the first portion, and the total number of wirings constituting the second portion is larger than the total number of wirings constituting the first portion. In the above configuration, the total number of wirings constituting the second portion included in the signal wiring for use in transmission of the driving signal and located on the side of the input terminal is larger than the total number of wirings constituting the first portion included in the signal wiring and overlapping, in a plan view, the at least coupling terminal included in the driving circuit, and thus, the wiring resistance of the second portion is greatly reduced, as compared with a configuration in which the total number of wirings constituting the second portion is equal to the total number of wirings constituting the first portion. Accordingly, in the signal wiring, heat generation and waveform blunting of the driving signal are reduced.

In configuration 2, namely, a preferable example of configuration 1, a plurality of relay wirings each electrically interconnecting the driving circuit and a corresponding one of the driving elements may be formed on a face on the side of the driving circuit among external faces of the base body portion, and at least one portion of a coupling region which is included in the base body portion and within which the relay wirings are formed may be located in a first direction in which the signal wiring extends when seen from the second portion and in a second direction intersecting with the first direction when seen from the first portion. The above configuration allows the signal wiring and the relay wirings to be formed utilizing the surface of the base body portion in an efficient manner, and thus brings about an advantage in which the downsizing of the base body portion is achieved.

In configuration 3, namely, a preferable example of configuration 1 or configuration 2, each of the relay wirings may be electrically coupled to a corresponding one of the driving elements via a first penetration wiring inside a corresponding one of penetration holes formed in the base body portion. In the above configuration, each of the relay wirings is electrically coupled to a corresponding one of the driving elements via the first penetration wiring inside a corresponding one of the penetration holes of the base body portion, and thus, the above configuration brings about an advantage in which the configuration of the liquid ejecting head is greatly simplified, as compared with a configuration in which the relay wirings are electrically coupled to the respective driving elements via, for example, a flexible wiring substrate.

In configuration 4, namely, a preferable example of any one of configurations 1 to 3, the signal wiring may include a first wiring portion formed on a first face on the side of the driving circuit among external faces of the base body portion, and a second wiring portion formed on a second face on the side opposite the first face among the external faces of the base body portion. Further, the first wiring portion and the second wiring portion may be electrically coupled to each other via at least one second penetration wiring inside at least one penetration hole formed in the base body portion, and in the second portion, the second wiring portion may include a plurality of wirings. In the above configuration, the signal wiring is constituted by the first wiring portion formed on the first face of the base body portion and the second wiring portion formed on the second face of the base body portion, and thus, the above configuration brings about an advantage in which a size of the base body portion, which is required to be sufficient to form the signal wiring, is greatly reduced, and concurrently therewith, the wiring resistance of the signal wiring is greatly reduced, as compared with a configuration in which the signal wiring is formed on only a single surface of the base body portion.

In configuration 5, namely, a preferable example of configuration 4, at least one coupling terminal included in the driving circuit and coupled to the first wiring portion does not overlap the at least one second penetration wiring in a plan view. In a configuration in which the at least one coupling terminal of the driving circuit overlaps the at least one second penetration wiring in a plan view, a wiring failure, such as wiring breaking, wiring damage, or the like, is likely to occur in the at least one second penetration wiring due to pressure applied to the base body portion from the at least one coupling terminal. With the above-described configuration, in which the at least one coupling terminal of the driving circuit does not overlap the at least one second penetration wiring in a plan view, even in the case where pressure is applied to the base body portion from the at least one coupling terminal, a failure of the at least one second penetration wiring due to the relevant pressure is reduced.

In configuration 6, namely, a preferable example of any one of configurations 1 to 5, the base body portion may be a long plate-shaped member, and the first portion may extend along a long side of the base body portion. In the above configuration, the first portion of the signal wiring extends along a long side of the base body portion, and thus, the above configuration brings about an advantage in which, for example, in a configuration in which a long-shaped driving circuit extending along the base body portion is disposed in the base body portion, the driving signal can be supplied over the whole of the long direction of the driving circuit from the signal wiring.

In configuration 7, namely, a preferable example of any one of configurations 1 to 6, the liquid ejecting head may further include a power supply wiring formed on the base body portion and being for use in supply of a power source voltage to the driving circuit from an input terminal. Further, the power supply wiring may include a third portion overlapping, in a plan view, at least one coupling terminal included in the driving circuit and coupled to the power supply wiring, and a fourth portion located on the side of the input terminal for the power source voltage when seen from the third portion, and the total number of wirings constituting the fourth portion may be larger than the total number of wirings constituting the third portion. In the above configuration, the total number of wirings constituting the fourth portion included in the power supply wiring for use in supply of a power source voltage to the driving circuit and located on the side of the input terminal is larger than the total number of wirings constituting the third portion included in the power supply wiring and overlapping the driving circuit, and thus, the wiring resistance of the fourth portion is greatly reduced, as compared with a configuration in which the total number of wirings constituting the fourth portion is equal to the total number of wirings constituting the third portion. Accordingly, the occurrence of problems in the power supply wiring, such as heat generation and the like, is reduced.

In configuration 8, namely, a preferable configuration of a liquid ejecting apparatus according to another aspect of the invention, the liquid ejecting apparatus includes the liquid ejecting head according to any one of configurations 1 to 7 having been exemplified above. An exemplification of a liquid ejecting apparatus is a printing apparatus that ejects ink, but the application of the liquid ejecting apparatus according to another aspect of the invention is not limited to the printing.

In configuration 9, namely, a preferable configuration of a wiring substrate according to a further aspect of the invention, the wiring substrate is used in a liquid ejecting head including a flow path formation portion in which a plurality of pressure chambers each communicated with a corresponding one of a plurality of nozzles are formed; a plurality of driving elements each configured to cause liquid inside a corresponding one of the pressure chambers to be ejected through a corresponding one of the nozzles; and a driving circuit configured to output a driving pulse for driving each of the driving elements to the each of the driving elements, and the wiring substrate includes a base body portion disposed between the flow path formation portion and the driving circuit; and a signal wiring formed on the base body portion and configured to transmit a driving signal for use in generation of the driving pulse by the driving circuit to the driving circuit from an input terminal. Further, the signal wiring includes a first portion, and a second portion located on the side of the input terminal when seen from the first portion, and the total number of wirings constituting the second portion is larger than the total number of wirings constituting the first portion. In the above configuration, the total number of wirings constituting the second portion included in the signal wiring for use in transmission of the driving signal and located on the side of the input terminal is larger than the total number of wirings constituting the first portion included in the signal wiring and overlapping, in a plan view, the at least coupling terminal included in the driving circuit, and thus, the wiring resistance of the second portion is greatly reduced, as compared with a configuration in which the total number of wirings constituting the second portion is equal to the total number of wirings constituting the first portion. Accordingly, in the signal wiring, heat generation and waveform blunting of the driving signal are reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
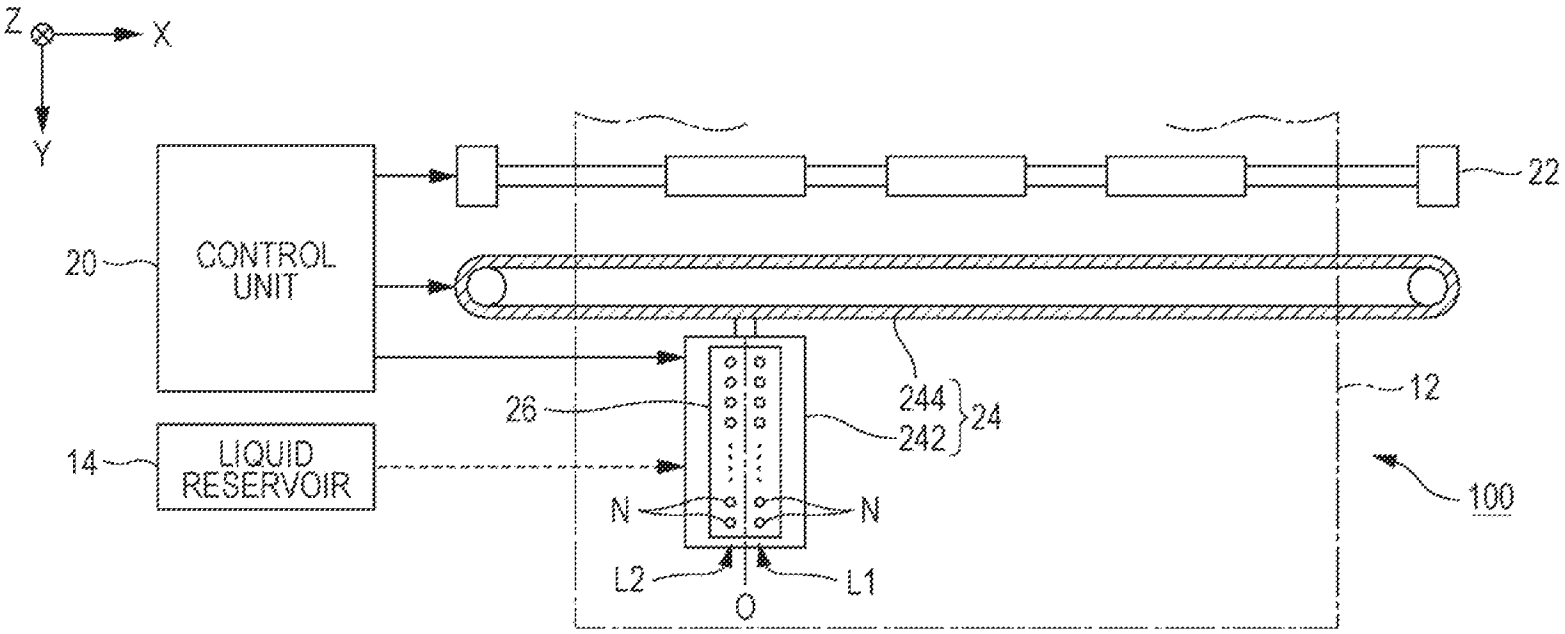
FIG. 1 is a block diagram illustrating a configuration of a liquid ejecting apparatus according to a first embodiment of the invention.

FIG. 1 is a configuration diagram exemplifying a configuration of a liquid ejecting apparatus 100, namely, a liquid ejecting apparatus according to a first embodiment of the invention. This liquid ejecting apparatus 100 of the first embodiment is an ink jet printing apparatus that ejects ink onto a medium 12. Here, the ink is an exemplification of the liquid. The medium 12 is typically printing paper, but printing target medium made of any one of materials, such as resin film, fabric, and the like, is used as the medium 12. As exemplified in FIG. 1, the liquid ejecting apparatus 100 mounts liquid reservoirs 14, namely, liquid reservoirs for storing the ink therein. As each of the liquid reservoirs 14, a liquid reservoir attachable/detachable to/from the body of the liquid ejecting apparatus 100, such as a cartridge, a bag-shaped ink pack formed of flexible film, or an ink tank capable of being replenished with the ink, is utilized. The each liquid reservoir 14 stores therein one of a plurality of kinds of inks having mutually different colors.

As exemplified in FIG. 1, the liquid ejecting apparatus 100 includes a control unit 20, a transport mechanism 22, a movement mechanism 24, and a liquid ejecting head 26. The control unit 20 includes, for example, a processing circuit such as a central processing unit (CPU), a field programmable gate array (FPGA), or the like, and a storage circuit such as a semiconductor memory unit or the like, and controls individual components of the liquid ejecting apparatus 100 in an integrated manner. The transport mechanism 22 transports the medium 12 in a Y direction under the control of the control unit 20.

The movement mechanism 24 causes the liquid ejecting head 26 to reciprocate in an X direction under the control of the control unit 20. The X direction is a direction intersecting with (typically, orthogonally intersecting with) the Y direction, in which the medium 12 is transported. The movement mechanism 24 of the first embodiment includes a transporting unit 242 (a carriage) and a transporting belt 244. The transporting unit 242 is an approximately box-shaped unit containing the liquid ejecting head 26, and is secured to the transporting belt 244. Here, a configuration in which a plurality of the liquid ejecting heads 26 are mounted in the transporting unit 242 and a configuration in which the liquid reservoirs 14 are mounted together with the liquid ejecting head 26 in the transporting unit 242 can be also employed.

Figure 2:
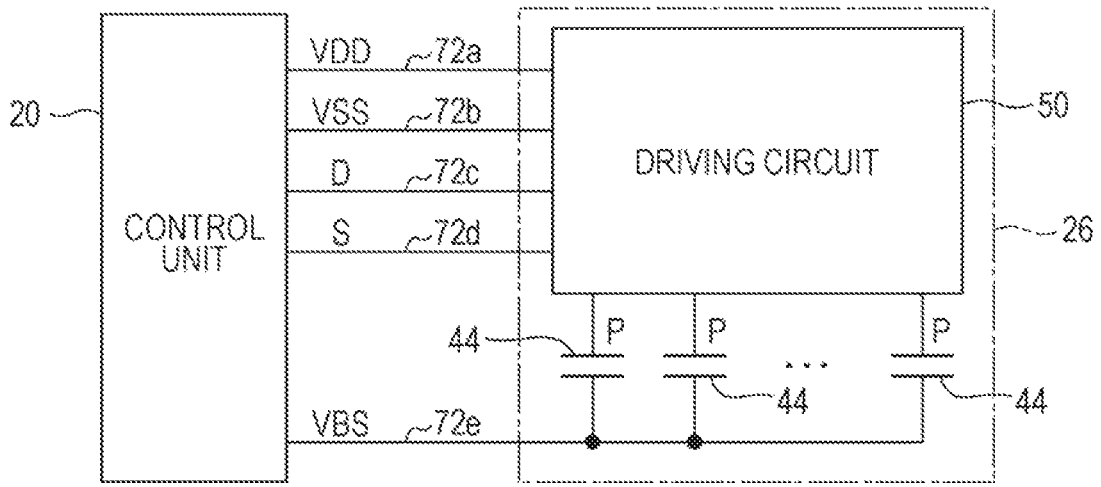
FIG. 2 is a block diagram illustrating a functional configuration of the liquid ejecting apparatus.
Figure 3:
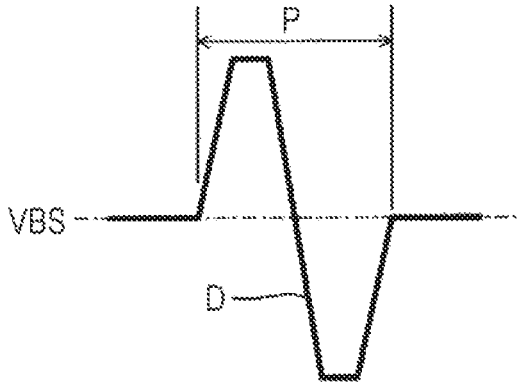
FIG. 3 is a waveform diagram of a driving signal.

The liquid ejecting head 26 ejects the inks supplied from the respective liquid reservoirs 14 onto the medium 12 through a plurality of nozzles (ejection holes) under the control of the control unit 20. The liquid ejecting head 26 ejects the inks onto the medium 12 in parallel with the transport of the medium 12 by the transport mechanism 22 as well as the iterative reciprocations of the transporting unit 242, thereby allowing desired images to be formed on the surface of the medium 12. It should be noted that a direction perpendicular to an X-Y plane (for example, a plane parallel to the surface of the medium 12) will be referred to as a Z direction hereinafter. A direction in which the inks are ejected by the liquid ejecting head 26 (typically, this direction being the vertical direction) corresponds to the Z direction FIG. 2 is a configuration diagram focusing on the function of the liquid ejecting apparatus 100. The illustrations of the transport mechanism 22 and the movement mechanism 24 are omitted for descriptive purposes. As exemplified in FIG. 2, the control unit 20 of the first embodiment generates a control signal S, a driving signal D, and a plurality of kinds of voltages (VDD, VSS, and VBS), and supplies these signal and voltages to the liquid ejecting head 26. The control signal S instructs, for each of nozzles N, the presence or absence (the ejection or non-ejection) of each of the inks. The driving signal D is a cyclic signal whose voltage cyclically varies relative to the voltage VBS, namely, a predetermined reference voltage (this voltage VBS being referred to as "a reference voltage VBS" hereinafter), and the driving signal D is used to eject the inks to the liquid ejecting head 26. As exemplified in FIG. 3, the driving signal D is a voltage signal including a driving pulse P for each predetermined cycle. In this case, another kind of driving signal D having a waveform including a plurality of driving pulses P may be utilized. The plurality of voltages supplied to the liquid ejecting head 26 from the control unit 20 includes the voltage VDD, namely, a higher level power source voltage VDD; the voltage VSS, namely, a lower level power source voltage VSS (a ground voltage); and the reference voltage VBS, which has been described above.

As exemplified in FIG. 2, the liquid ejecting head 26 includes a plurality of piezoelectric elements 44 (each being an exemplification of the driving element) and a driving circuit 50. Here, each of the plurality of piezoelectric elements 44 is associated with a corresponding one of the mutually different nozzles N, and the driving circuit 50 drives the each of the plurality of piezoelectric elements 44. The driving circuit 50 is configured to include a plurality of switches each associated with a corresponding one of the mutually different piezoelectric elements 44, and controls, for each of the piezoelectric elements 44, the supply or non-supply of the driving pulse P of the driving signal D to the each piezoelectric element 44 in accordance with the control signal S. Specifically, the driving circuit 50 supplies the driving pulse P to a piezoelectric element 44 associated with a nozzle to which the ejection of ink is instructed by the control signal S; while the driving circuit 50 does not supply the driving pulse P to a piezoelectric element 44 associated with a nozzle to which the non-ejection of ink is instructed by the control signal S.

Figure 4:
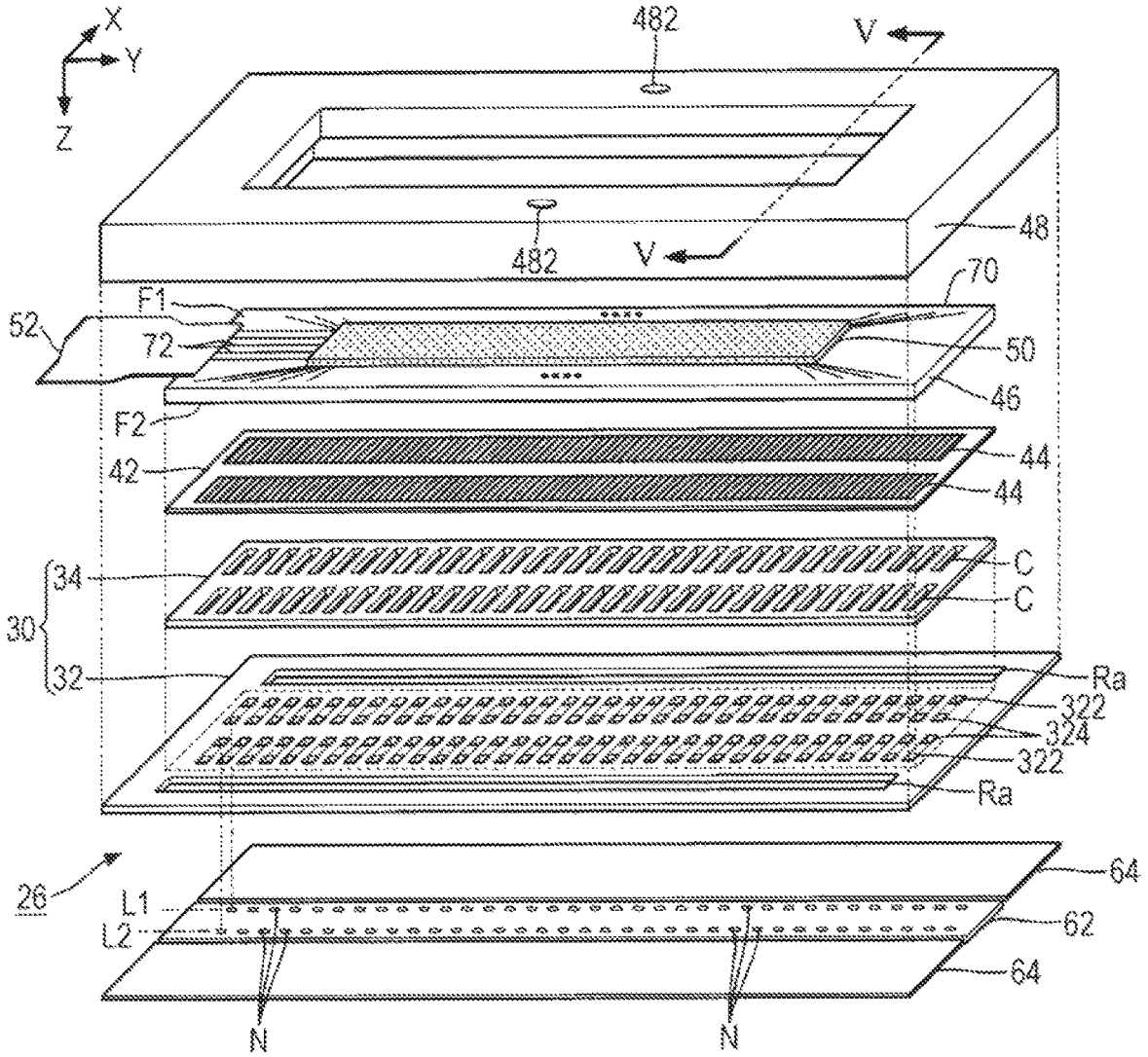
FIG. 4 is a disassembled perspective view of a liquid ejecting head.
Figure 5:
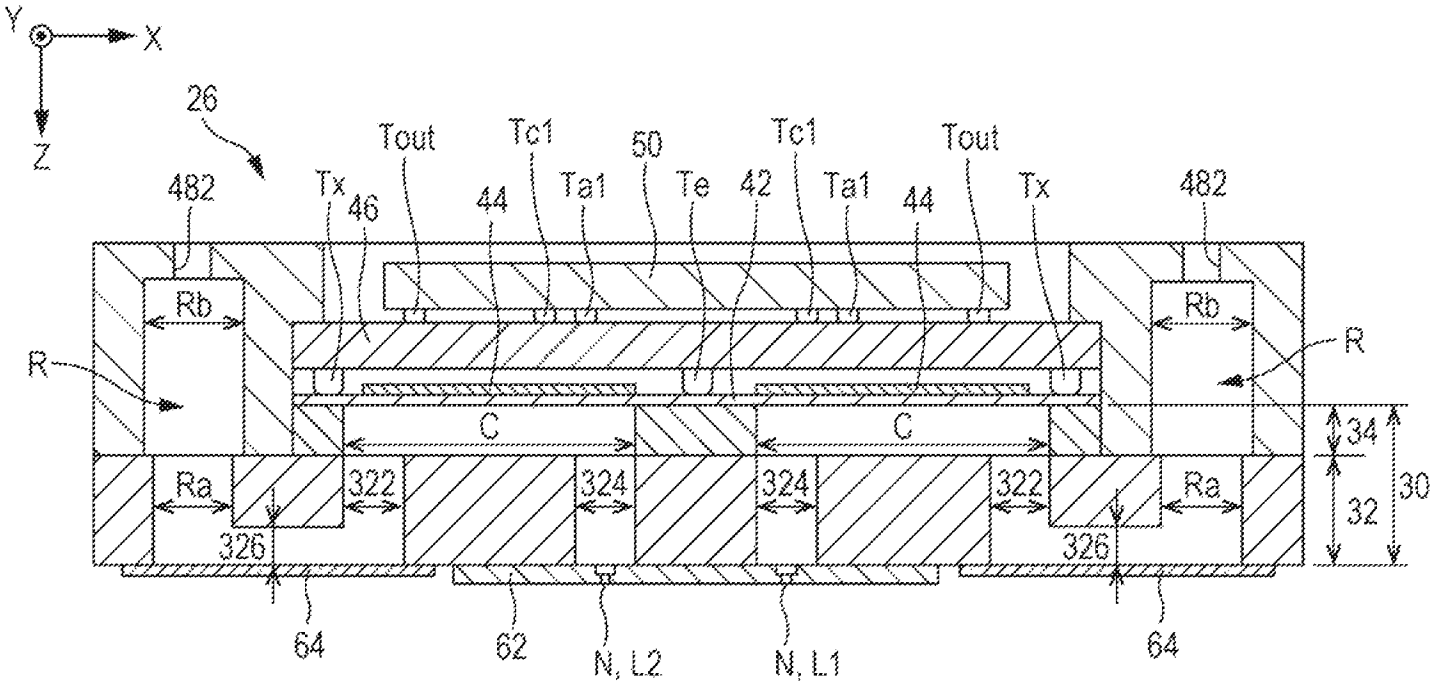
FIG. 5 is a cross-sectional view of the liquid ejecting head, taken along the line V-V of FIG. 4.

FIG. 4 is a disassembled perspective view of the liquid ejecting head 26, and FIG. 5 is a cross-sectional view of the liquid ejecting head 26, taken along the line V-V of FIG. 4. As exemplified in FIG. 4, the liquid ejecting head 26 includes the plurality of nozzles N arranged in the Y direction. The plurality of nozzles N of the first embodiment are sectioned into a first row L1 and a second row L2, these rows L1 and L2 being arranged in parallel to each other with a space interposed therebetween in the X direction. Each of the first rows L1 and the second row L2 is an aggregation of a plurality of nozzles N arranged in a straight line in the Y direction. In this case, Y-direction positions of corresponding nozzles N can be made different from each between the first row L1 and the second row L2 (namely, a zigzag arrangement or a staggered arrangement), but, in the following description, a configuration in which the Y-direction positions of corresponding nozzles N correspond to each other between the first row L1 and the second row L2 will be exemplified for descriptive purposes. As understood from FIG. 5, the liquid ejecting head 26 of the first embodiment has a structure in which components in relation to each of the nozzles N of the first row L1 and components in relation to each of the nozzles N of the second row L2 are approximately axisymmetrically arranged.

As exemplified in FIGS. 4 and 5, the liquid ejecting head 26 includes a flow path formation portion 30. The flow path formation portion 30 is a portion having a structure for forming flow paths to supply the inks to the plurality of nozzles N. The flow path formation portion 30 of the first embodiment is constituted by stack layers of a flow path substrate 32 and a pressure chamber substrate 34. The flow path substrate 32 and the pressure chamber substrate 34 are plate-shaped members that are long in the Y direction. The pressure chamber substrate 34 is secured to the surface of a negative Z direction side of the flow path substrate 32.

As exemplified in FIG. 4, a vibration plate 42, a wiring substrate 46, a chassis portion 48, and the driving circuit 50 are disposed on a negative Z direction side of the flow path formation portion 30; while a nozzle plate 62 and vibration absorbers 64 are disposed on a positive Z direction side of the flow path formation portion 30. The individual components of the liquid ejecting head 26 are schematically plate-shaped members that are long in the Y direction, just like the flow path substrate 32 and the pressure chamber substrate 34, and are joined to each other using, for example, an adhesive agent.

The nozzle plate 62 is a plate-shaped member in which the plurality of nozzles N are formed, and is disposed on the surface of a positive Z direction side of the flow path substrate 32. Each of the plurality of nozzles N is a circular shaped penetration hole that allows the ink to pass through the relevant penetration hole. Further, the plurality of nozzles N constituting the first row L1 and the plurality of nozzles N constituting the second row L2 are formed in the nozzle plate 62 of the first embodiment. The nozzle plate 62 is manufactured by processing a silicon (Si) single-crystal substrate utilizing, for example, a semiconductor manufacturing technique (a processing technique, such as dry edging or wet edging). In this regard, however, in the manufacturing of the nozzle plate 62, a known material and a known manufacturing method can be optionally employed.

As exemplified in FIGS. 4 and 5, in the flow path substrate 32, a space Ra, a plurality of supply flow paths 322, a plurality of communication flow paths 324, and a supply liquid chamber 326 are formed for each of the first row L1 and the second row L2. The space Ra is an opening formed in a long shape along the Y direction in a plan view (that is, when viewed from the Z direction), and one of the supply flow paths 322 and a corresponding one of the communication flow paths 324 are penetration holes that are formed for each of the nozzles N. The supply liquid chamber 326 is a space that is formed across the plurality of nozzles N and that is formed in a long shape along the Y direction, and allows the space Ra and the plurality of supply flow paths 322 to communicate with each other. Each of the plurality of communication flow paths 324 overlaps one nozzle N corresponding to the each communication flow path 324 in a plan view.

As exemplified in FIGS. 4 and 5, the pressure chamber substrate 34 is a plate-shaped member in which a plurality of pressure chambers C are formed for each of the first row L1 and the second row L2. The plurality of pressure chambers C are arranged in the Y direction. Each of the pressure chambers C (cavities) is a space formed for each of the nozzles N and having a long shape along the X direction in a plan view. The flow path substrate 32 and the pressure chamber substrate 34 are manufactured by, just like the above-described nozzle plate 62, processing a silicon single-crystal substrate utilizing, for example, a semiconductor manufacturing technique. In this regard, however, in the manufacturing of the flow path substrate 32 and the pressure chamber substrate 34, a known material and a known manufacturing method can be optionally employed.

As exemplified in FIG. 4, the vibration plate 42 is formed on the surface of the opposite side of the pressure chamber substrate 34 from the flow path substrate 32. The vibration plate 42 of the first embodiment is a plate-shaped member capable of elastically vibrating. In this case, for each of regions which are included in a plate-shaped member having a predetermined thickness and each of which is associated with a corresponding one of the pressure chambers C, part of a corresponding plate-thickness direction portion may be selectively removed and thereby part or the whole of the vibration plate 42 may formed integrally with the pressure chamber substrate 34.

As understood from FIG. 4, the pressure chambers C are spaced located between the flow path substrate 32 and the vibration plate 42. A plurality of pressure chambers C are arranged in the Y direction for each of the first row L1 and the second row L2. As exemplified in FIGS. 4 and 5, each of the pressure chambers C communicates with a corresponding one of the communication flow paths 324 and a corresponding one of the supply flow paths 322.

Thus, each of the pressure chambers C communicates with a corresponding one of the nozzles N via a corresponding one of the communication flow paths 324, and further communicates with the space Ra via a corresponding one of the supply flow paths 322 and the supply liquid chamber 326.

As exemplified in FIGS. 4 and 5, on the face of the opposite side of the vibration plate 42 from the pressure chambers C, a plurality of piezoelectric elements 44 each associated with a corresponding one of the mutually different nozzles N are formed for each of the first row L1 and the second row L2. Each of the piezoelectric elements 44 is a passive element that is deformed by being supplied with the driving pulse P.

Figure 6:
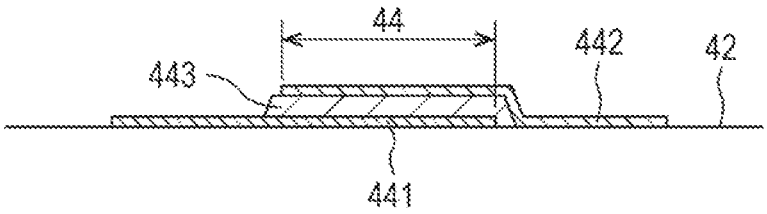
FIG. 6 is a cross-sectional view of a piezoelectric element, illustrating a configuration of the piezoelectric element.

FIG. 6 is a cross-sectional view of a piezoelectric element 44. As exemplified in FIG. 6, the piezoelectric element 44 is a stacked-layer material in which a piezoelectric layer 443 is interposed between a first electrode 441 and a second electrode 442, namely, a first electrode and a second electrode that are disposed so as to be opposite to each other. The first electrode 441 (a lower electrode) is formed on the surface of the vibration plate 42, and is a common electrode that is continuously formed across the plurality of piezoelectric elements 44; while the second electrode 442 (an upper electrode) is a separate electrode that is formed for each of the plurality of piezoelectric elements 44. A portion overlapping with the first electrode 441, the second electrode 442, and the piezoelectric material 443 in a plan view functions as the each piezoelectric element 44. Upon vibration of a portion of the vibration plate 42 in conjunction with the deformation of a corresponding piezoelectric element 44, the pressure of ink filled in a corresponding pressure chamber C varies, thereby causing the ink filled in the corresponding pressure chamber C to pass through a corresponding communication flow path 324 and a corresponding nozzle N and be ejected to the outside. In this case, a configuration in which the first electrode 441 is formed as a separate electrode for each of the piezoelectric elements 44 and the second electrode 442 is formed as a common electrode, or a configuration in which both of the first electrode 441 and the second electrode 442 are formed as separate electrodes can be employed.

The wiring substrate 46 of FIG. 4 is a plate-shaped member that is opposite to and spaced from the surface of the vibration plate 42, on which the plurality of piezoelectric elements 44 are formed. The wiring substrate 46 of the first embodiment also functions as a reinforcing plate for reinforcing the mechanical strength of the liquid ejecting head 26 and a sealing plate for protecting and sealing the piezoelectric elements 44. As exemplified in FIG. 4, the wiring substrate 46 is electrically coupled to the control unit 20 via an external wiring 52. The external wiring 52 is a flexible wiring substrate for use in supplying the individual kinds of voltages (VDD, VSS, and VBS) and the signals (S and D) to the wiring substrate 46 from the control unit 20. For example, coupling components, such as a flexible printed circuit (FPC), a flexible flat cable (FFC), or the like, are suitably employed as the external wiring 52.

The chassis portion 48 is a case for storing therein the inks to be supplied to the plurality of pressure chambers C (and further, the plurality of nozzles N). As exemplified in FIG. 5, in the chassis portion 48 of the first embodiment, a space Rb is formed for each of the first row L1 and second row L2. The space Rb of the chassis portion 48 and a corresponding space Ra of the flow path substrate 32 communicate with each other. A space constituted by the space Rb and the corresponding space Ra functions as a liquid storage chamber (a reservoir) R, namely, a liquid storage chamber for storing therein ink to be supplied to the plurality of pressure chambers C. The ink is supplied to the liquid storage chamber R via an introduction inlet 482, namely, an introduction inlet formed in the chassis portion 48. The ink inside the liquid storage chamber R is supplied to each of the pressure chambers C via the supply liquid chamber 326 and a corresponding supply flow path 322. Each of the vibration absorbers 64 is a flexible film (a compliance substrate) constituting the wall face of a corresponding one of the liquid storage chambers R, and absorbs the variation of pressure of the ink inside the corresponding liquid storage chamber R.

The wiring substrate 46 includes a base body portion 70 and a plurality of wirings 72. The base body portion 70 is an insulating plate-shaped member that is long in the Y direction, and is located between the flow path formation portion 30 and the driving circuit 50. The base body portion 70 is manufactured by processing a silicon single-crystal substrate utilizing, for example, a semiconductor manufacturing technique. In this regard, however, a known material and a known manufacturing method can be optionally employed in the manufacturing of the base body portion 70.

As exemplified in FIG. 4, the base body portion 70 includes a first face F1 and a second face F2, the first face F1 and the second face F2 being located on mutually opposite sides, and is secured to the surface of the opposite side of the pressure chamber substrate 34 (or the vibration plate 42) from the flow path substrate 32 utilizing, for example, a adherence agent. Specifically, the base body portion 70 is disposed in such a way that the second face F2 is opposite to and spaced from the surface of the vibration plate 42. As exemplified in FIG. 4, the driving circuit 50 and the external wiring 52 are mounted on the first face F1 of the base body portion 70. The driving circuit 50 is an IC chip that is long along the long direction of the base body portion 70 (namely, the Y direction). The external wiring 52 is mounted on a negative Y direction side end portion of the first face F1 of the base body portion 70.

The plurality of wirings 72 for transmitting the voltages (VDD, VSS, and VBS) and the signals (S and D), which are supplied from the control unit 20 via the external wiring 52, are formed on the first face F1 and the second face F2 of the base body portion 70. Specifically, as exemplified in FIG. 2, a power supply wiring 72*a*, namely, a power supply wiring for supplying the higher level power source voltage VDD; a power supply wiring 72*b*, namely, a power supply wiring for supplying the lower level power source voltage VSS; a signal wiring 72*c*, namely, a signal wiring for supplying the driving signal D; a signal wiring 72*d*; namely, a signal wiring for supplying the control signal S; and a reference wiring 72*e*, namely, a reference wiring for supplying the reference voltage VBS, are formed on both of the first face F1 and the second face F2. The power source voltage VDD is supplied to the driving circuit 50 via the power supply wiring 72*a*: the power source voltage VSS is supplied to the driving circuit 50 via the power supply wiring 72*b*; the driving signal D is supplied to the driving circuit 50 via the signal wiring 72*c*; and the control signal S is supplied to the driving circuit 50 via the signal wiring 72*d*; while the reference voltage VBS is supplied to second electrode 442 of each of the plurality of piezoelectric elements 44 via the reference wiring 72*e* without passing through the driving circuit 50.

Figure 7:
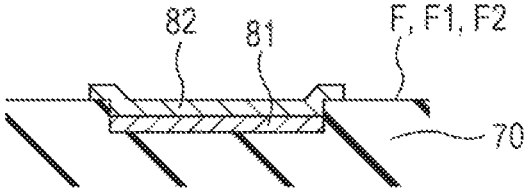
FIG. 7 is a cross-sectional view of stack layer wirings, illustrating a configuration of the stack layer wirings.

The power supply wiring 72*a*, the power supply wiring 72*b*, the signal wiring 72*c*, and the reference wiring 72*e* are wiring sets each constituted by stacked layers of a plurality of conductive layers (each of the wiring set being referred to as "a stacked-layer wiring" hereinafter). FIG. 7 is a configuration diagram of the stacked-layer wiring. As exemplified in FIG. 7, a groove portion along a stacked-layer wiring is formed in a surface F (namely, the first face F1 or the second face F2 of the base body portion 70). The groove portion is a concave portion having a rectangular shape in its cross section and being concave relative to the surface of the base body portion 70. The stacked-layer wiring is constituted by stacked layers of a first wiring 81 and a second wiring 82. The first wiring 81 is a conductive pattern formed of metal having a low resistance, such as copper (Cu) or the like. As exemplified in FIG. 7, the first wiring 81 is a trench wiring that is formed (buried) inside the grove portion; while the second wiring 82 is a conductive pattern coating the first wiring 81. The second wiring 82 coats the first wiring 81 inside the groove portion and further continuously extends onto the surface F of the base body portion 70. Specifically, the second wiring 82 is constituted by stacked layers of an adhesion layer and a wiring layer, the adhesion layer being formed on the surface of the first wiring 81 and being made of metal, such as titanium (Ti), tungsten (W), or the like, the wiring layer being formed on the surface of the closely contact layer and being made of metal, such as gold (Au) or the like. he adhesion layer is a conductive layer for increasing the adhesion between the first wiring 81 and the wiring layer. As described above, the stacked-layer wiring formed on the wiring substrate 46 includes the first wiring 81 formed inside the groove portion of the base body portion 70, and thus, the wiring resistance of the stacked-layer wiring in the above-described configuration is greatly lowered, as compared with a configuration in which a wiring is formed using only a conductive pattern formed on the surface F of the base body portion 70.

Figure 8:
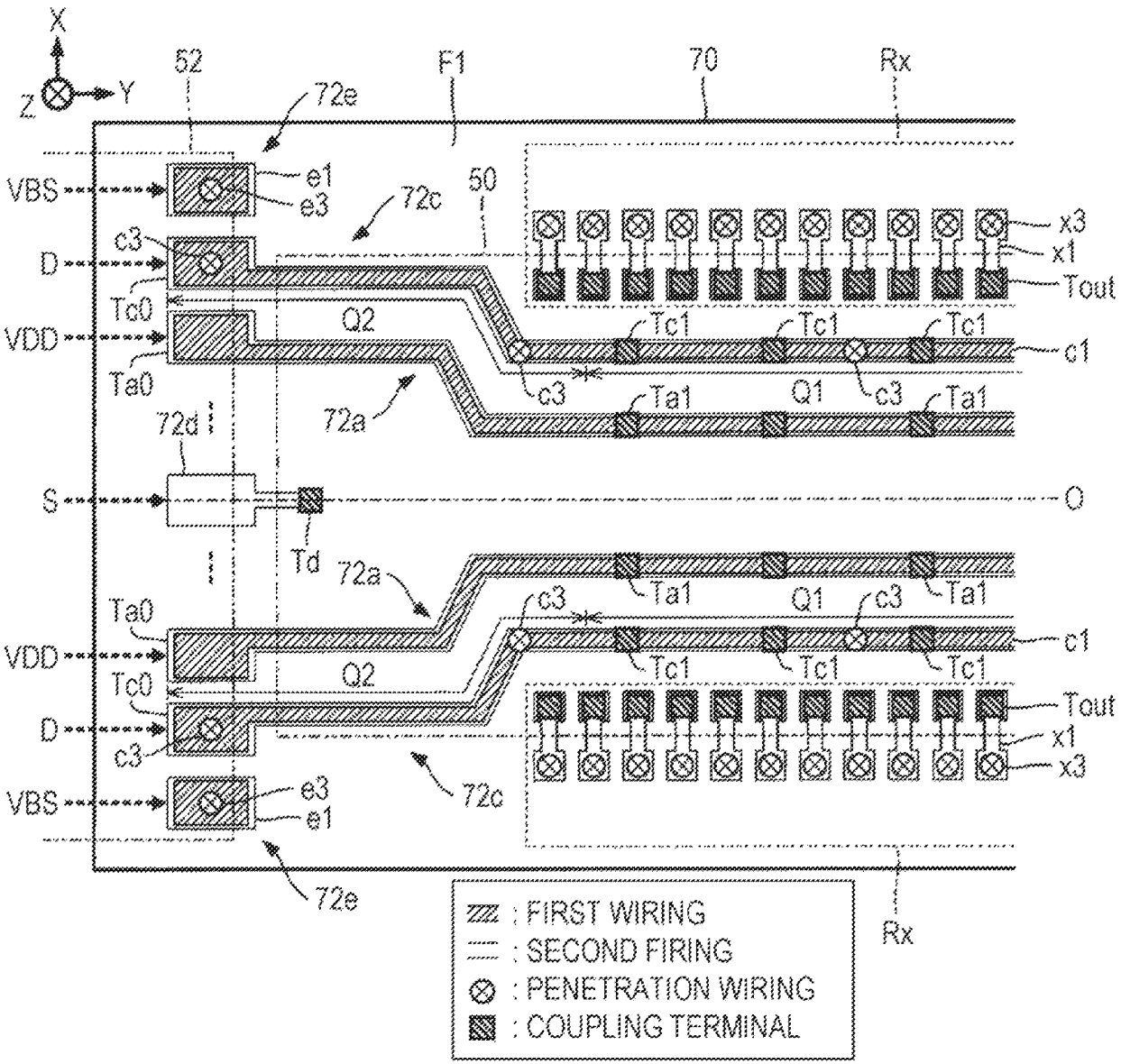
FIG. 8 is a plan view of a first face of a base body portion in a wiring substrate.
Figure 9:
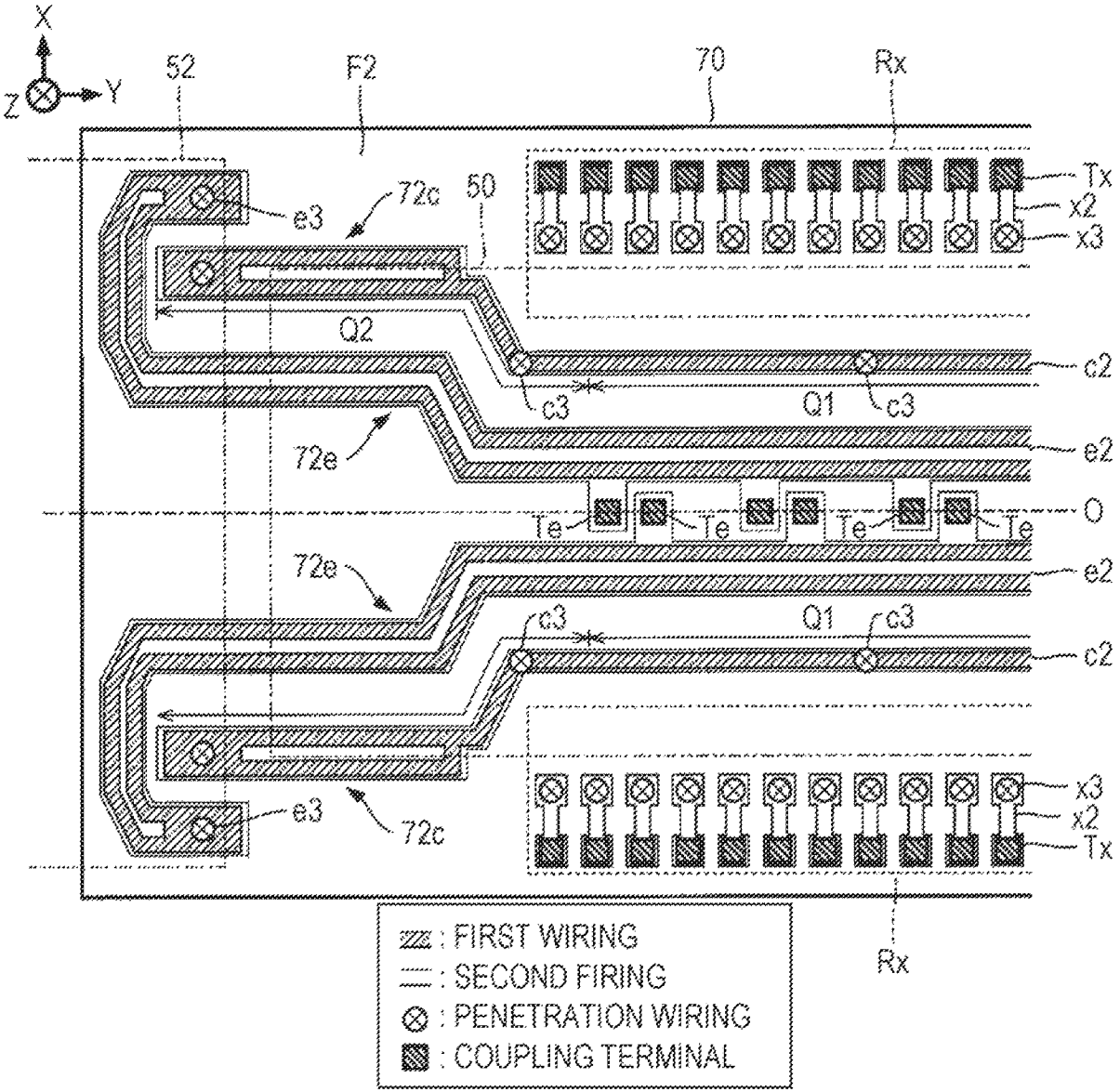
FIG. 9 is a plan view of a second face of the base body portion in the wiring substrate.

FIG. 8 is a plan view of the first face F1 of the base body portion 70 in the wiring substrate 46, and FIG. 9 is a plan view of the second face F2 of the base body portion 70 in the wiring substrate 46. For the purpose of facilitating understanding of the relation between the first face F1 and the second face F2, in FIG. 9, a plan view of wirings formed on the second face F2 of the base body portion 70 at the time when the wirings are seen from the positive Z direction side in a way similar to that of FIG. 8 (that is, in the case where the wirings are assumed to be seen through the base body portion 70) is illustrated. Further, a center line O is illustrated in FIGS. 8 and 9. This center line O is a center line of the base body portion 70, and extends in parallel to the Y direction.

As exemplified in FIG. 8, a plurality of relay wirings x1, namely, a plurality of relay wirings each associated with a corresponding one of the plurality of mutually different piezoelectric elements 44, are formed for each of the first row L1 and the second row L2 on the first face F1 of the base body portion 70. The plurality of relay wirings x1 are located within a region Rx, namely, a specific region of the base body portion 70 (the region Rx being referred to as "a coupling region Rx" hereinafter), and are arranged along a long side of the base body portion in the Y direction. For the relay wirings x1, end portions on the side of the center line O are each coupled to a corresponding one of coupling terminals Tout, namely, coupling terminals formed on the bottom face of the driving circuit 50 (the bottom face being a face facing the wiring substrate 46). Each of the coupling terminals Tout is a terminal through which the driving pulse P is output. For example, a resin core bump is suitably utilized as the each coupling terminal Tout. This resin core bump is a coupling terminal resulting from forming a coupling electrode on the surface of a protrusion formed of a resin material.

As exemplified in FIG. 9, a plurality of relay wirings x2, namely, a plurality of relay wirings each associated with a corresponding one of the plurality of mutually different piezoelectric elements 44, are formed for each of the first row L1 and the second row L2 on the second face F2 of the base body portion 70. The plurality of relay wirings x2 are arranged along the long side of the base body portion 70 in the Y direction, just like the plurality of relay wirings x1. Each of the relay wirings x1 and the relay wirings x2 is not constituted by a stacked-layer wiring, such as that exemplified in FIG. 7, but is constituted by a single-layer conductive pattern. For example, each of the relay wirings x1 and the relay wirings x2 is formed of the same layer as the second wiring 82 of the stacked-layer wiring. In this regard, however, each of the relay wirings x1 and the relay wirings x2 may be formed using the stacked-layer wiring.

As understood from FIGS. 8 and 9, each of end portions constituting the respective relay wirings x1 of the first face F1 and located on the side opposite the center line O is electrically coupled to a corresponding one of end portions constituting the respective relay wirings x2 of the second face F2 and located on the side of the center line O via a corresponding one of penetration wirings x3 (each being an exemplification of the first penetration wiring). Each of the penetration wirings x3 is a conductive member (a through-silicon via (TSV)) formed inside a penetration hole formed in the base body portion 70. Further, each of end portions constituting the respective relay wirings x2 and located on the side opposite the center line O is electrically coupled to a corresponding one of the second electrodes 442 (separate electrodes) of the respective piezoelectric elements 44 via a corresponding one of coupling terminals Tx, namely, coupling terminals (for example, resin core bumps) formed on the second face F2. That is, each of the relay wirings x1 and a corresponding one of the relay wirings x2 are electrically coupled to a corresponding one of the piezoelectric elements 44 via a corresponding one of the penetration wirings x3 inside the respective penetration holes formed in the base body portion 70. Thus, the driving pulse P output from each of the coupling terminals Tout of the driving circuit 50 is supplied from a corresponding one of the coupling terminals Tx to a corresponding one of the second electrodes 442 of the respective piezoelectric elements 44 via a wiring formed of a corresponding one of the relay wirings x1, a corresponding one of the penetration wirings x3, and a corresponding one of the relay wirings x2. As described above, in the first embodiment, each of the relay wirings x1 is electrically coupled to a corresponding one of the piezoelectric elements 44 via a corresponding one of the penetration wirings x3 inside the respective penetration holes formed in the base body portion 70, and thus, this configuration brings about an advantage in which the configuration of the liquid ejecting head 26 is greatly simplified, as compared with a configuration in which the each relay wiring x1 is electrically coupled to the corresponding piezoelectric element 44 via a coupling component, such as the FPC, the FFC, or the like.

The reference wiring 72*e* illustrated in FIGS. 8 and 9 is a wiring for supplying the reference voltage VBS to the first electrode 441 (the common electrode) of the piezoelectric elements 44, and is configured to include a first wiring portion e1, a second wiring portion e2, and a penetration wiring e3. The first wiring portion e1 is a stacked-layer wiring formed on the first face F1 of the base body portion 70, and the second wiring portion e2 is a stacked-layer wiring formed on the second face F2 of the base body portion 70.

The penetration wiring e3 is an conductive member formed inside a penetration hole penetrating through the base body portion 70, and electrically interconnects the first wiring portion e1 and the second wiring portion e2. As exemplified in FIG. 8, the first wiring portion e1 is an input terminal to which the reference voltage VBS is supplied from the external wiring 52. As exemplified in FIG. 9, the second wiring portion e2 extends in the Y direction from an end portion overlapping the first wiring portion e1 in a plan view, and is electrically coupled to the first electrodes 441 via a plurality of coupling terminals Te, namely, coupling terminals formed on the second face F2. Specifically, the second wiring portion e2 is a stacked-layer wiring constituted by a plurality of ("two" in the exemplification of FIG. 9) first wirings 81 coupled to each other, and second wirings 82 each coating a corresponding one of the plurality of first wirings 81. As understood from the above description, the reference voltage VBS supplied from the external wiring 52 is supplied from the individual coupling terminals Te to the first electrodes 441 via the first wiring portion e1, the penetration wiring e3, and the second wiring portion e2.

The signal wiring 72*c* is a wiring for supplying the driving signal D to the driving circuit 50, and is configured to include a first wiring portion c1, a second wiring portion c2, and a plurality of penetration wirings c3. The first wiring portion c1 is a stacked-layer wiring formed on the first face F1 of the base body portion 70, and the second wiring portion c2 is a stacked-layer wiring formed one the second face F2 of the base body portion 70. As illustrated in FIG. 8, the first wiring portion c1 extends from an input terminal Tc0, namely, a negative Y direction side end portion, toward the positive side of the Y direction. The input terminal Tc0 is supplied with the driving signal D from the external wiring 52. The first wiring portion c1 is electrically coupled to a plurality of coupling terminals Tc1, namely, coupling terminals formed on the bottom face of the driving circuit 50 along the relevant first wiring portion c1. Further, the plurality of coupling terminals Tc1 are resin core bumps formed on the bottom face of the driving circuit 50 (the bottom face being a face facing the wiring substrate 46), and are arranged at given intervals along the first wiring portion c1 in the Y direction. As understood from the above description, the driving signal D having been supplied from the external wiring 52 to the input terminal Tc0 is supplied from a plurality of points (the coupling terminals Tc1) whose Y-direction positions are mutually different, to the driving circuit 50 through the signal wiring 72*c*.

As exemplified in FIG. 9, the second wiring portion c2 on the second face F2 extends in the Y direction so as to overlap the first wiring portion c1 on the first face F1. Each of the plurality of penetration wirings c3 (each being an exemplification of the second penetration wiring) is formed inside a penetration hole penetrating through the base body portion 70, and electrically interconnects the first wiring portion c1 and the second wiring portion c2. That is, the first wiring portion c1 is electrically coupled to the second wiring portion c2 through each of the penetration wirings c3 at a corresponding one of a plurality of points in a direction in which the relevant first wiring portion c1 extends. As described above, in the first embodiment, the signal wiring 72*c* is constituted by the first wiring portion c1 formed on the first face F1 and the second wiring portion c2 formed on the second face F2, and thus, this configuration brings about an advantage in which the size of the base body portion 70, the relevant size being required to be sufficient to form the signal wiring 72*c*, can be greatly reduced, and concurrently therewith, the wiring resistance of the signal wiring 72*c* can be greatly lowered, as compared with a configuration in which the signal wiring 72*c* is formed using only a conductive pattern formed on the first face F1.

By the way, in a configuration in which a coupling terminal Tc1 of the driving circuit 50 overlaps a penetration wiring c3 in a plan view, a wiring failure, such as wiring breaking, wiring damage, or the like, is likely to occur in the penetration wiring c3 due to, for example, pressure applied from the coupling terminal Tc1 at the time of mounting the driving circuit 50. Taking into consideration the above situation, in the first embodiment, each of the plurality of coupling terminals Tc1 of the driving circuit 50 does not overlap with any one of the plurality of penetration wirings c3. This configuration brings about an advantage in which, even when pressure is applied to the base body portion 70 from the coupling terminals Tc1, the wiring failure of any one of the penetration wirings c3 due to the pressure can be eliminated.

As exemplified in FIGS. 8 and 9, the signal wiring 72*c* is sectioned into a first portion Q1 and a second portion Q2 along its extension direction. In the signal wiring 72*c*, the first portion Q1 is a portion extending along the Y direction (the direction of the long side of the base body portion 70), and overlapping the arrangement of the plurality of coupling terminals Tc1 of the driving circuit 50 in a plan view. Each of the plurality of coupling terminals Tc1 is brought into contact with the first portion Q1 of the signal wiring 72*c*. The first portion Q1 of the signal wiring 72*c* extends along the long side of the base body portion 70, and thus, this configuration brings about an advantage in which the driving signal D can be supplied from the signal wiring 72*c* to the driving circuit 50 over a broad region in the long direction of the driving circuit 50.

On the other hand, the second portion Q2 is a portion located on the side of the input terminal Tc0 (on the negative side of the Y direction) when seen from the first portion Q1. Specifically, a portion on the side of the input terminal Tc0 when seen from one coupling terminal Tc1 that is the closest to the input terminal Tc0 among the plurality of coupling terminals Tc1 corresponds to the second portion Q2. When focusing on the transmission direction of the driving signal D, the second portion Q2 is located on the upstream side of the transmission direction of the driving signal D, compared with the first portion Q1. When focusing on positions in the X direction, the second portion Q2 is located on the side opposite the center line O when seen from the first portion Q1.

In the first portion Q1, the total number of first wirings 81 of a stacked-layer wiring constituting each of the first wiring portion c1 and the second wiring portion c2 is one. That is, the first portion Q1 is constituted by totally two first wirings 81 including one first wiring 81 of the first wiring portion c1 and one first wiring 81 of the second wiring portion c2. On the other hand, in the second portion Q2, the total number of first wirings 81 of the first wiring portion c1 is one, just like the first portion Q1; while the second wiring portion c2 is constituted by a plurality of mutually coupled first wirings 81 (a bundle of a plurality of first wirings 81). That is, the second portion Q2 is constituted by totally three first wirings 81 including one first wiring 81 of the first wiring portion c1 and two first wirings 81 of the second wiring portion c2. As understood from the above description, in the first embodiment, for the signal wiring 72*c*, the total number of first wirings 81 constituting the second portion Q2 is larger than the total number of first wirings 81 constituting the first portion Q1. The first wiring 81 of the first wiring portion c1 and the first wiring 81 of the second wiring portion c2 are formed in such a way as to have approximately the same wiring width. Accordingly, in the signal wiring 72*c*, the resistance of the second portion Q2 is lower than that of the first portion Q1.

As exemplified in FIGS. 8 and 9, at least one portion of the coupling region Rx within which the relay wirings x1 are formed is located on the positive side of the Y direction (an exemplification of the first direction) when seen from the second portion Q2 of the signal wiring 72*c* and is located on the positive side of the X direction (an exemplification of the second direction) when seen from the first portion Q1 of the signal wiring 72*c*. Specifically, a Y-direction region within which the first portion Q1 is formed and a Y-direction region of the coupling region Rx overlap with each other, and an X-direction region within which the second portion Q2 is formed and an X-direction region of the coupling region Rx overlap with each other. That is, the plurality of relay wirings x1 are formed within the coupling region Rx secured on the first face F1 by the bending of the signal wiring 72*c*. With the above configuration, the signal wiring 72*c* and the plurality of relay wirings x1 are formed utilizing the first face F1 in an efficient manner, thus enabling the base body portion 70 to be downsized.

The power supply wiring 72*a* of FIG. 8 is a stacked-layer wiring formed on the first face F1 of the base body portion 70, and extends toward the positive side of the Y direction from an input terminal Ta0, namely, a negative Y direction side end portion. The input terminal Ta0 is supplied with the power source voltage VDD from the external wiring 52. The power supply wiring 72*a* is electrically coupled to a plurality of coupling terminals Ta1, namely, a plurality of coupling terminals formed on the bottom face of the driving circuit 50 along the relevant power supply wiring 72*a*. The plurality of coupling terminals Ta1 are resin core bumps formed on the bottom face of the driving circuit 50, and are arranged at given intervals along the power supply wiring 72*a* in the Y direction. It should be noted that the power supply wiring 72*b* for supplying the lower level power source voltage VSS is also formed on the base body portion 70, but the illustration of the power supply wiring 72*b* is omitted in FIGS. 8 and 9 for descriptive reasons because the configuration of the power supply wiring 72*b* is the same as that of the power supply wiring 72*a*.

The signal wiring 72*d* of FIG. 8 is formed on the first face F1 of the base body portion 70, and extends from its end portion on the negative side of the Y direction to the positive side of the Y direction. The signal wiring 72*d* is coupled to a coupling terminal Td, namely, a coupling terminal formed adjacent to an end portion located on the negative side of the Y direction on the bottom face of the driving circuit 50. The signal wiring 72*d* is formed of a single layer of, for example, copper (Cu) or gold (Au). That is, the stacked-layer structure having been exemplified in FIG. 7 is not employed in the signal wiring 72*d*. The signal wiring 72*d* is formed of, for example, the same layer as the second wiring 82 of the stacked-layer wiring.

As described above, in the first embodiment, the total number of wirings constituting the second portion Q2, which is included in the signal wiring 72*c* for transmitting the driving signal D and which is located on the side of the input terminal Tc0, is larger than the total number of wirings constituting the first portion Q1, which is included in the signal wiring 72*c* and which overlaps the coupling terminals of the driving circuit 50. That is, in the above-described configuration of the first embodiment, the wiring resistance of the second portion Q2 is greatly lowered, as compared with a configuration in which the total number of the wirings of the first portion Q1 is equal to the total number of the wirings of the second portion Q2. Thus, the above-described configuration of the first embodiment brings about an advantage in which heat generation and waveform blunting of the driving signal in the signal wiring 72*c* can be reduced.

Second Embodiment

A second embodiment of the invention will be described below. It should be noted that, for elements included in individual exemplifications below and having functions similar to those of the elements of the first embodiment, reference signs having been used in the description of the first embodiment will be also used, and thereby the detailed descriptions of the elements included in the individual exemplifications below will be appropriately omitted.

Figure 10:
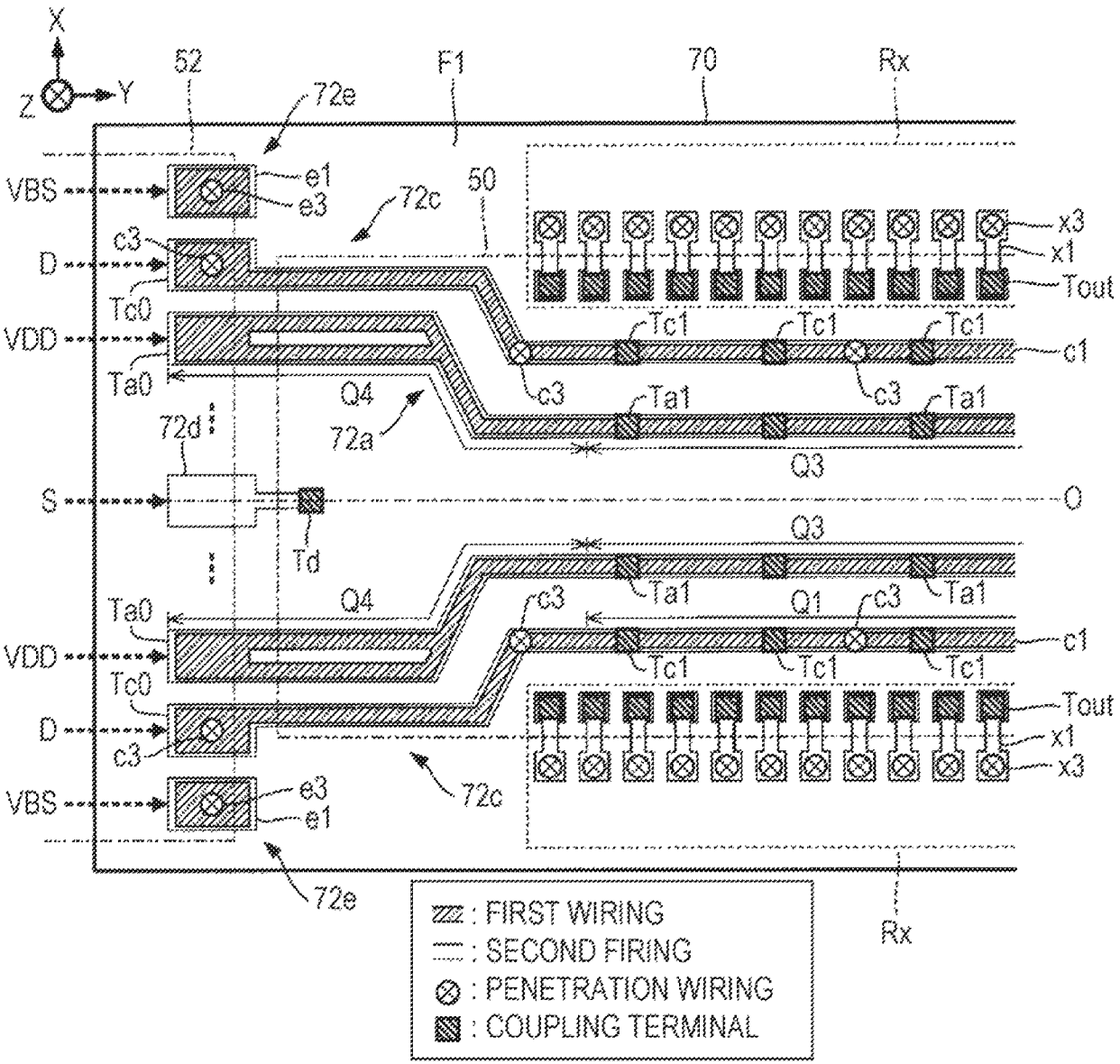
FIG. 10 is a plan view of a first face of a base body portion in a second embodiment.

FIG. 10 is a plan view of the first face F1 of the base body portion 70 in the wiring substrate 46 of this second embodiment. The second embodiment is different from the first embodiment in the configuration of the power supply wiring 72*a*. Since wirings other than the power supply wiring 72*a* are similar to those of the first embodiment, in the following description, only the power supply wiring 72*a* will be described, and the wirings other than the power supply wiring 72*a* will be omitted from the description below.

The power supply wiring 72*a* of the second embodiment is sectioned into a third portion Q3 and a fourth portion Q4 in a plan view. The third portion Q3 is a portion included in the power supply wiring 72*a* and overlapping the arrangement of the plurality of coupling terminals Ta1 of the driving circuit 50; while the fourth portion Q4 is a portion located on the side of the input terminal Ta0 (the negative side of the Y direction) when seen from the third portion Q3. Specifically, a portion on the side of the input terminal Ta0 when seen from one coupling terminal Ta1 that is the closest to the input terminal Ta0 among the plurality of coupling terminals Ta1 corresponds to the fourth portion Q4. When focusing on the direction of electric current corresponding to the power source voltage VDD, the fourth portion Q4 is located on the upper stream side of the electric current corresponding to the power source voltage VDD, compared with the third portion Q3.

The total number of first wirings 81 of a stacked-layer wiring constituting the third portion Q3 of the power supply wiring 72*a* is one; while a stacked-layer wiring constituting the fourth portion Q4 of the power supply wiring 72*a* is configured to include two first wirings 81. As understood from the above description, in the second embodiment, for the power supply wiring 72*a*, the total number of the first wirings 81 constituting the fourth portion Q4 is larger than the total number of the first wirings 81 constituting the third portion Q3. The first wiring 81 of the third portion Q3 and the first wiring 81 of the fourth portion Q4 are formed in such a way as to have approximately the same wiring width. With the above configuration, in the power supply wiring 72*a*, the resistance of the fourth portion Q4 is lower than that of the third portion Q3. Thus, the above-described configuration of the second embodiment brings about an advantage in which problems, such as heat generation and the like, in the power supply wiring 72*a* can be reduced. It should be noted that, although the power supply wiring 72*a* for supplying the power source voltage VDD has been focused in the above description, a configuration similar to the configuration of the power supply wiring 72*a* of the second embodiment can be employed in other wirings for supplying voltages other than the power source voltage VDD (for example, the lower level power source voltage VSS and the reference voltage VBS).

MODIFICATION EXAMPLES

The individual embodiments having been exemplified above can be variously modified. Specific modification configurations that can be applied to the individual embodiments described above will be exemplified below. Two or more configurations that are optionally selected from among exemplifications below can be appropriately combined within a scope where there is no inconsistency among the relevant configurations.

(1) The total number of the first wirings 81 constituting the first portion Q1 of the signal wiring 72*c* and the total number of the first wirings 81 constituting the second portion Q2 of the signal wiring 72*c* are not limited to those of the exemplification of the first embodiment. For example, the first portion Q1 of the signal wiring 72*c* may be constituted by four or more first wirings 81, and the second portion Q2 thereof may be constituted by three or more first wirings 81. Similarly, the total number of the first wirings 81 constituting the third portion Q3 of the power supply wiring 72*a* and the total number of the first wirings 81 constituting the fourth portion Q4 of the power supply wiring 72*a* are not limited to those of the exemplification of the second embodiment. For example, the third portion Q3 of the power supply wiring 72*a* may be constituted by three or more first wirings 81, and the fourth portion Q4 thereof may be constituted by three or more second wirings 82.

(2) In the first embodiment, the signal wiring 72*c* is formed using the first wiring portion c1 formed on the first face F1 of the base body portion 70 and the second wiring portion c2 formed on the second face F2 of the base body portion 70, but the signal wiring 72*c* may be formed using only a conductive pattern formed on the first face F1 of the base body portion 70. Even when the configuration in which the signal wiring 72*c* is formed using only the conductive pattern of the first face F1 is employed, a configuration in which, in the signal wiring 72*c*, the total number of the first wirings 81 constituting the first portion Q2 is larger than the total number of the first wirings 81 constituting the second portion Q1 is preferable. Further, in the second embodiment, the power supply wiring 72*a* is formed using the conductive pattern formed on the first face F1 of the base body portion 70, but the power supply wiring 72*a* may be constituted by a conductive pattern formed on the first face F1 and a conductive pattern formed on the second face F2. Even when the configuration in which the power supply wiring 72*a* is formed on the first face F1 and the second face F2 is employed, a configuration in which, in the power supply wiring 72*a*, the total number of the first wirings 81 constituting the fourth portion Q4 is larger than the total number of the first wirings 81 constituting the third portion Q3 is preferable. As understood from the above description, when a wiring is formed on the surface of the base body portion 70, the wiring is preferable regardless of whether the relevant wiring is formed on both faces or only a single face of the base body portion 70, provided that the relevant wiring is configured such that the total number of wirings of a portion B, namely, a portion corresponding to, for example, the second portion Q2 or the fourth portion Q4 and being located on the side nearer an input terminal than a portion A, namely, a portion corresponding to, for example, the first portion Q1 or the third portion Q3, is larger than the total number of wirings of the portion A.

(3) In the individual embodiments described above, one system of driving signal D has been exemplified, but a plurality of systems of driving signal D having mutually different waveforms may be utilized.

In this case, the driving circuit 50 selectively supplies a driving pulse P included in any one of the plurality of systems of driving signal D to each of the piezoelectric elements 44. In the above configuration, for each of the plurality of systems of driving signal D, a signal wiring similar to the signal wiring 72*c* of the first embodiment is formed.

(4) In the individual embodiments described above, each of the wirings (the power supply wiring 72*a*, the power supply wiring 72*b*, the signal wiring 72*c*, and the reference wiring 72*e*) of the wiring substrate 46 is constituted by the stacked-layer wiring, but the each wiring is not limited to the stacked-layer wiring. For example, each of the power supply wiring 72*a*, the power supply wiring 72*b*, the signal wiring 72*c*, and the reference wiring 72*e* may be constituted by a single-layer conductive pattern.

(5) A driving element for ejecting liquid (for example, ink) inside a corresponding pressure chamber C through a corresponding nozzle N is not limited to the piezoelectric element 44 having been exemplified in the individual embodiments described above. For example, a heat generation element that is heated to cause air bubbles to be generated inside a corresponding pressure chamber C so as to cause pressure inside the corresponding pressure chamber C to vary can be utilized as the driving element. As understood from the above exemplification, the driving element is comprehensively represented as an element that causes liquid inside a corresponding pressure chamber C to be ejected through a corresponding nozzle N (typically, the relevant element being an element that applies pressure to the inside of the corresponding pressure chamber C), regardless of which of the operation schemes (namely, the scheme using piezoelectricity or the scheme using heat) is employed and regardless of what a specific configuration is.

(6) In the individual embodiments described above, the serial type liquid ejecting apparatus 100 that reciprocates the transporting unit 242 mounting the liquid ejecting head 26 has been exemplified, but the invention can be applied to a line type liquid ejecting apparatus with its plurality of nozzles N distributed across the entire width of the medium 12.

(7) The liquid ejecting apparatus 100 having been exemplified in the individual embodiments described above can be employed not only in devices that are exclusively used in the printing, but also various devices, such as a facsimile device, a copying machine, and the like. Naturally, the application of the liquid ejecting apparatus according to the invention is not limited to the printing. For example, a liquid ejecting apparatus that ejects solutions of color materials is utilized as a manufacturing apparatus for forming color filters for display apparatuses, such as a liquid crystal display panel and the like. Further, a liquid ejecting apparatus that ejects solutions of conductive materials is utilized as a manufacturing apparatus for forming wirings and electrodes of wiring substrates. Further, a liquid ejecting apparatus that ejects solutions of organic materials related to a living body is utilized as a manufacturing apparatus for manufacturing, for example, biotips.

What is claimed is:

1. A liquid ejecting head comprising:

a flow path formation portion in which a plurality of pressure chambers each communicating with a corresponding one of a plurality of nozzles are formed;

a plurality of driving elements each configured to cause liquid inside a corresponding one of the pressure chambers to be ejected through a corresponding one of the nozzles;

a driving circuit configured to output a driving pulse for driving each of the driving elements to the each of the driving elements; and a wiring substrate including a base body portion disposed between the flow path formation portion and the driving circuit, and a signal wiring formed on the base body portion and configured to transmit a driving signal for use in generation of the driving pulse by the driving circuit to the driving circuit from an input terminal, wherein the signal wiring includes a first portion overlapping, in a plan view, at least one coupling terminal included in the driving circuit and coupled to the signal wiring, and a second portion located on a side of the input terminal when seen from the first portion, and wherein a total number of wirings constituting the second portion is larger than a total number of wirings constituting the first portion.

2. The liquid ejecting head according to claim 1, wherein a plurality of relay wirings each electrically interconnecting the driving circuit and a corresponding one of the driving elements are formed on a face on a side of the driving circuit in the base body portion, and wherein at least one portion of a coupling region which is included in the base body portion and within which the relay wirings are formed is located in a first direction in which the signal wiring extends when seen from the second portion and in a second direction intersecting with the first direction when seen from the first portion.

3. The liquid ejecting head according to claim 1, wherein each of the relay wirings is electrically coupled to a corresponding one of the driving elements via a first penetration wiring inside a corresponding one of penetration holes formed in the base body portion.

4. The liquid ejecting head according to claim 1, wherein the signal wiring includes a first wiring portion formed on a first face on a side of the driving circuit in the base body portion, and a second wiring portion formed on a second face on a side opposite the first face in the base body portion, wherein the first wiring portion and the second wiring portion are electrically coupled to each other via at least one second penetration wiring inside at least one penetration hole formed in the base body portion, and wherein, in the second portion, the second wiring portion includes a plurality of wirings.

5. The liquid ejecting head according to claim 4, wherein at least one coupling terminal included in the driving circuit and coupled to the first wiring portion does not overlap the at least one second penetration wiring in a plan view.

6. The liquid ejecting head according to claim 1, wherein the base body portion is a long plate-shaped member, and the first portion extends along a long side of the base body portion.

7. The liquid ejecting head according to claim 1 further comprising a power supply wiring formed on the base body portion and being for use in supply of a power source voltage to the driving circuit from an input terminal, wherein the power supply wiring includes a third portion overlapping, in a plan view, at least one coupling terminal included in the driving circuit and coupled to the power supply wiring, and a fourth portion located on a side of the input terminal for the power source voltage when seen from the third portion, and wherein a total number of wirings constituting the fourth portion is larger than a total number of wirings constituting the third portion.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

15. A wiring substrate for use in a liquid ejecting head including a flow path formation portion in which a plurality of pressure chambers each communicated with a corresponding one of a plurality of nozzles are formed, a plurality of driving elements each configured to cause liquid inside a corresponding one of the pressure chambers to be ejected through a corresponding one of the nozzles, and a driving circuit configured to output a driving pulse for driving each of the driving elements to the each of the driving elements, the wiring substrate comprising:

a base body portion disposed between the flow path formation portion and the driving circuit; and a signal wiring formed on the base body portion and configured to transmit a driving signal for use in generation of the driving pulse by the driving circuit to the driving circuit from an input terminal, wherein the signal wiring includes a first portion, and a second portion located on a side of the input terminal when seen from the first portion, and wherein a total number of wirings constituting the second portion is larger than a total number of wirings constituting the first portion.

* * * * *